United States Patent [19]

Hummel

[11] 4,407,494

[45] Oct. 4, 1983

[54] TOY AIRCRAFT

[76] Inventor: David M. Hummel, 722 Miami Ave., Terrace Park, Ohio 45174

[21] Appl. No.: 294,762

[22] Filed: Aug. 20, 1981

[51] Int. Cl.[3] ..... A63G 31/00

[52] U.S. Cl. ..... 272/1 D; 46/1 B; 46/1 L

[58] Field of Search ..... 46/1 B, 1 L, 1 H, 74 R, 46/76 R; 272/1 C, 1 D

[56] References Cited

U.S. PATENT DOCUMENTS 2,258,531 10/1941 Baldwin ..... 46/1 L
2,864,613 12/1958 Porter ..... 46/1 B X
3,608,234 12/1969 Davidson ..... 46/1 B X
3,656,256 4/1972 Maskell et al. ..... 46/1 L
4,270,301 6/1981 Meek ..... 46/1 L

*Primary Examiner*—Mickey Yu
*Attorney, Agent, or Firm*—Wood, Herron & Evans

[57] ABSTRACT

A toy aircraft formed of corrugated paperboard. A generally rectangular fuselage has a canopy secured to its upper surface and laterally projecting wings secured to its side walls. The fuselage has large openings in the top and bottom walls through which a child may thrust the upper portion of his body with his head contained within the canopy so that the child can carry the aircraft around and simulate flying maneuvers.

5 Claims, 16 Drawing Figures

TOY AIRCRAFT

This invention relates to a child's toy, and more particularly, the invention relates to a lightweight aircraft adapted to be carried by a child with its head and shoulders projecting into the fuselage of the aircraft.

An objective of the present invention has been to provide a toy such as an aircraft or space ship in which a child, moving about, can simulate the maneuvers of the aircraft by running, tilting the body from side-to-side and fore and aft.

It is a further objective of the invention that the aircraft be lightweight so as to be easily carried when placed about the upper portion of the child and that the aircraft be easily assembled and disassembled with the attendant advantages in manufacturing, shipment and storage.

It has been another objective of the invention to provide such a toy totally formed out of corrugated board so that it can be manufactured economically while, nevertheless, having sufficient strength and rigidity to withstand the rigors of child's play.

The objectives of the invention are attained by providing a generally rigid enclosure, preferably a fuselage, the enclosure having an opening in the bottom wall through which the head and shoulders of a child can pass and an opening in the top wall through which a child can see in order to maneuver the aircraft. In the preferred form of the invention, the device comprises a generally rectangular box-like fuselage having wings projecting laterally from the fuselage and a canopy fixed to the top of the fuselage. The wings and canopy are provided with tabs which are insertable into slots in the walls of the fuselage so as to removably join the wings and canopy to the fuselage.

The invention further provides a transverse brace that is die cut while forming one of the upper and lower openings in the fuselage and is connected between the top and bottom walls of the fuselage, the brace preferably having instrumentation printed on it so as to simulate the interior of an aircraft or space ship.

It is a further feature of the invention to provide panels, formed when the upper and lower openings in the fuselage are cut, the panels being snap-fitted together at their edges to form V-shaped side walls on the interior of the fuselage. The V-shaped side walls provide surfaces for engagement by the forearms of the child so as to assist the child in supporting the aircraft for maneuvers.

The several objectives and features of the invention will become more readily apparent from the following detailed description taken in conjunction with the accompanying drawings in which.

Figure 1:
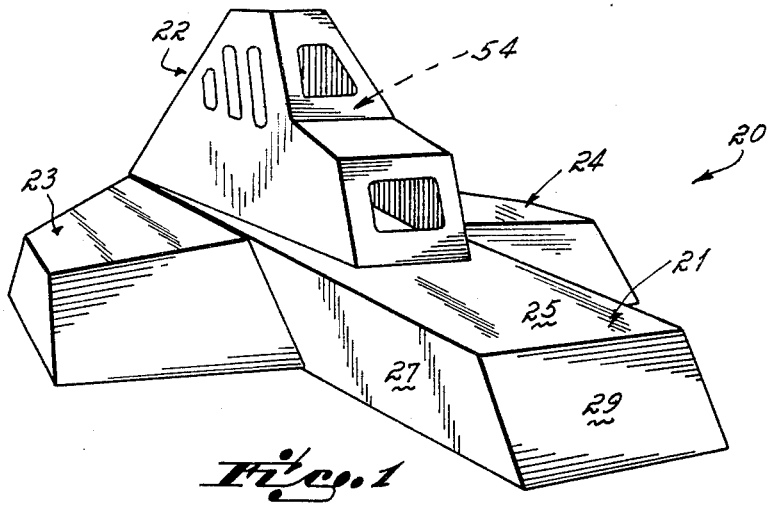
FIG. 1 is a perspective view of an aircraft of the present invention.
Figure 2:
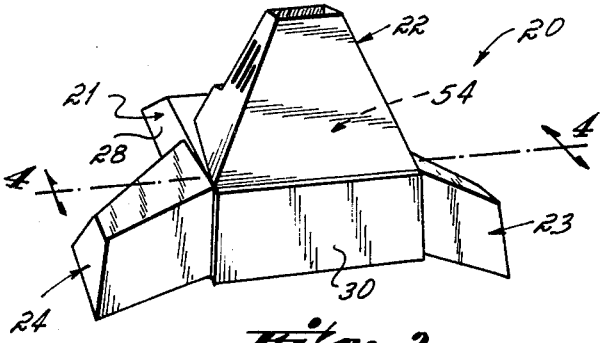
FIG. 2 is an other perspective view taken at the rear of the aircraft.
Figure 3:
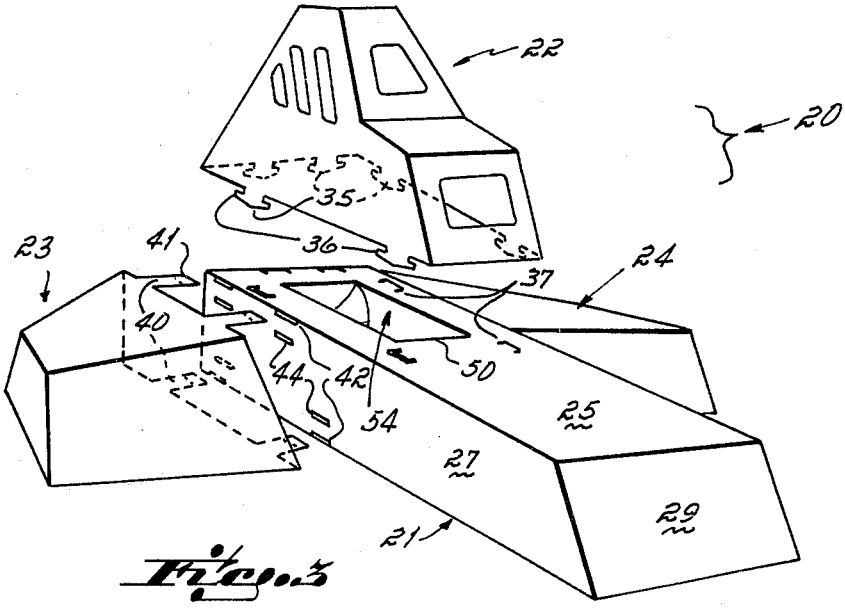
FIG. 3 is a disassembled perspective view of the aircraft.

Referring to FIGS. 1 through 3, the aircraft indicated at 20 is formed of a generally rectangular fuselage 21 to which a canopy 22 and a pair of wings 23 and 24 are attached. The fuselage has a top wall 25, a bottom wall 26, side walls 27 and 28, a front wall 29 and a back wall 30 (FIG. 2).

The canopy has depending lock tabs 35 each having laterally projecting stubs 36 permitting them to be folded to a channel-shape then slid through channel-shaped slots 37 in the top wall 25 of the fuselage. The stubs 36 are then straightened to secure the canopy to the fuselage.

The wings 23 and 24 each have four tabs 40 having hinged ends 41. The tabs 40 are adapted to be inserted in slots 42 in the side walls 27 and 28 of the fuselage with the ends 41 returned through inner slots 44 in the side walls of the fuselage. In this simple manner, the canopy and wings are assembled to the fuselage.

Figure 4:
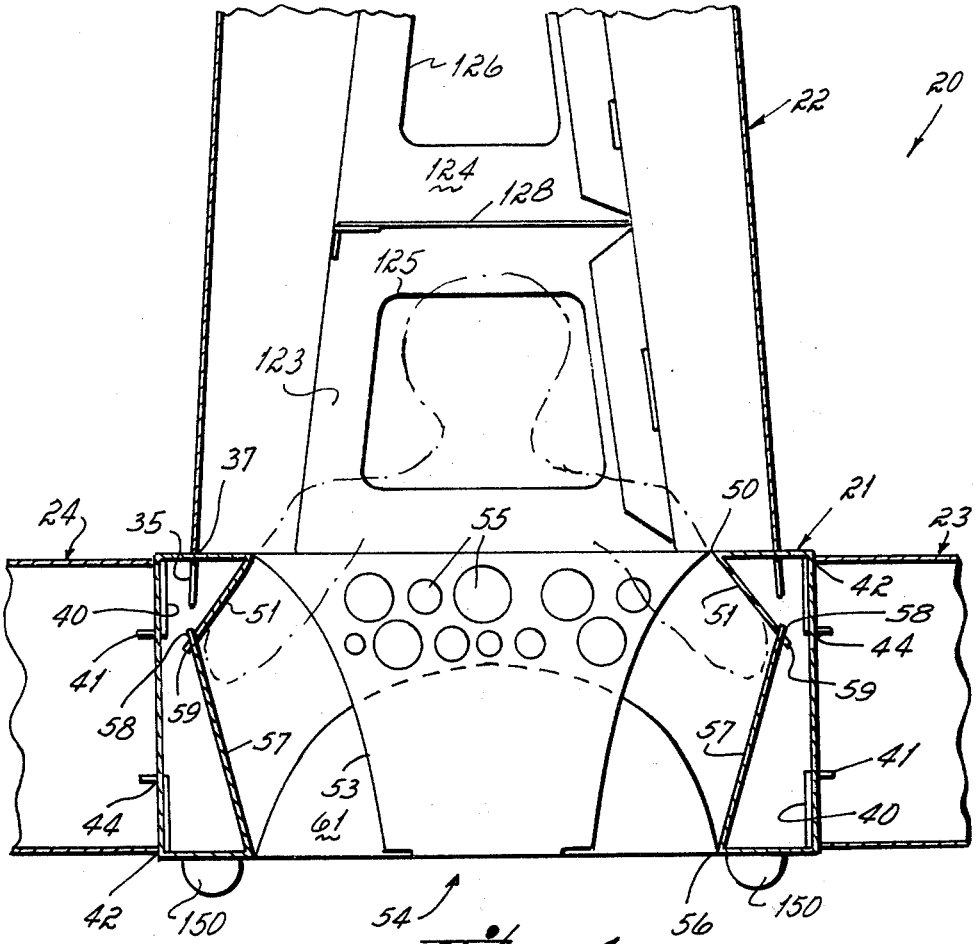
FIG. 4 is a cross-sectional view taken along lines 4—4 of FIG. 2.
Figure 5:
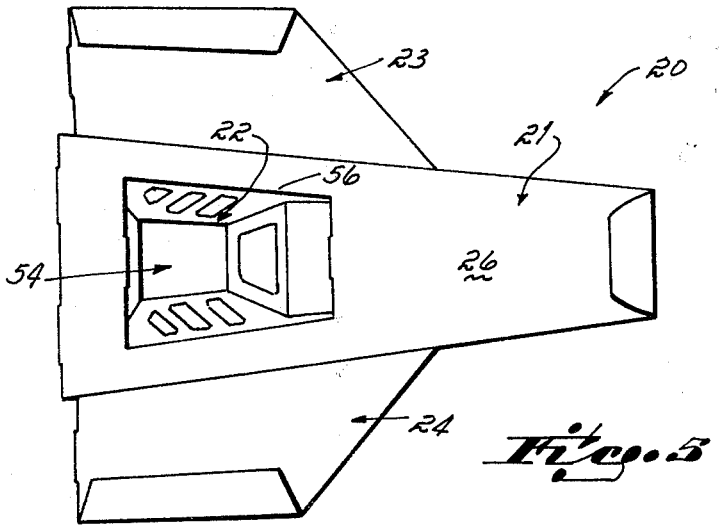
FIG. 5 is a bottom plan view of the aircraft.

Referring to FIG. 4 the top wall 25 of the fuselage has a large opening 50 through which the head and shoulders of the child may pass. The opening 50 is formed in part by die-cutting panels 51 on each side of the opening and folding them downwardly. At the rear and front of the opening 50, panels 52 and 53 (FIGS. 6 and 10) are die-cut and folded downwardly. It can be seen from FIG. 4 that the panel 53 is printed with instrumentation simulating indicia 55 so that when it is in position, it appears to be an instrument panel for the pilot.

The bottom wall 26 has an opening 56. It is formed by cutting two lateral panels 57 from the bottom wall and folding them upwardly into a snap-fitted contact with the edges of the side panels 51 from the top wall. These panels interlock by means of the engagement of tab 58 on the panels 57 with mating notches 59 on the panels 51. When snapped together and forced over center to the position shown in FIG. 4, the panels 51 and 57 form V-shaped internal walls in the inside of the fuselage in the area serving as a cockpit. The upper panels 51 provide surfaces which are engageable by the forearms of the child carrying the aircraft and enable the child to support the aircraft as he maneuvers about.

Figure 6:
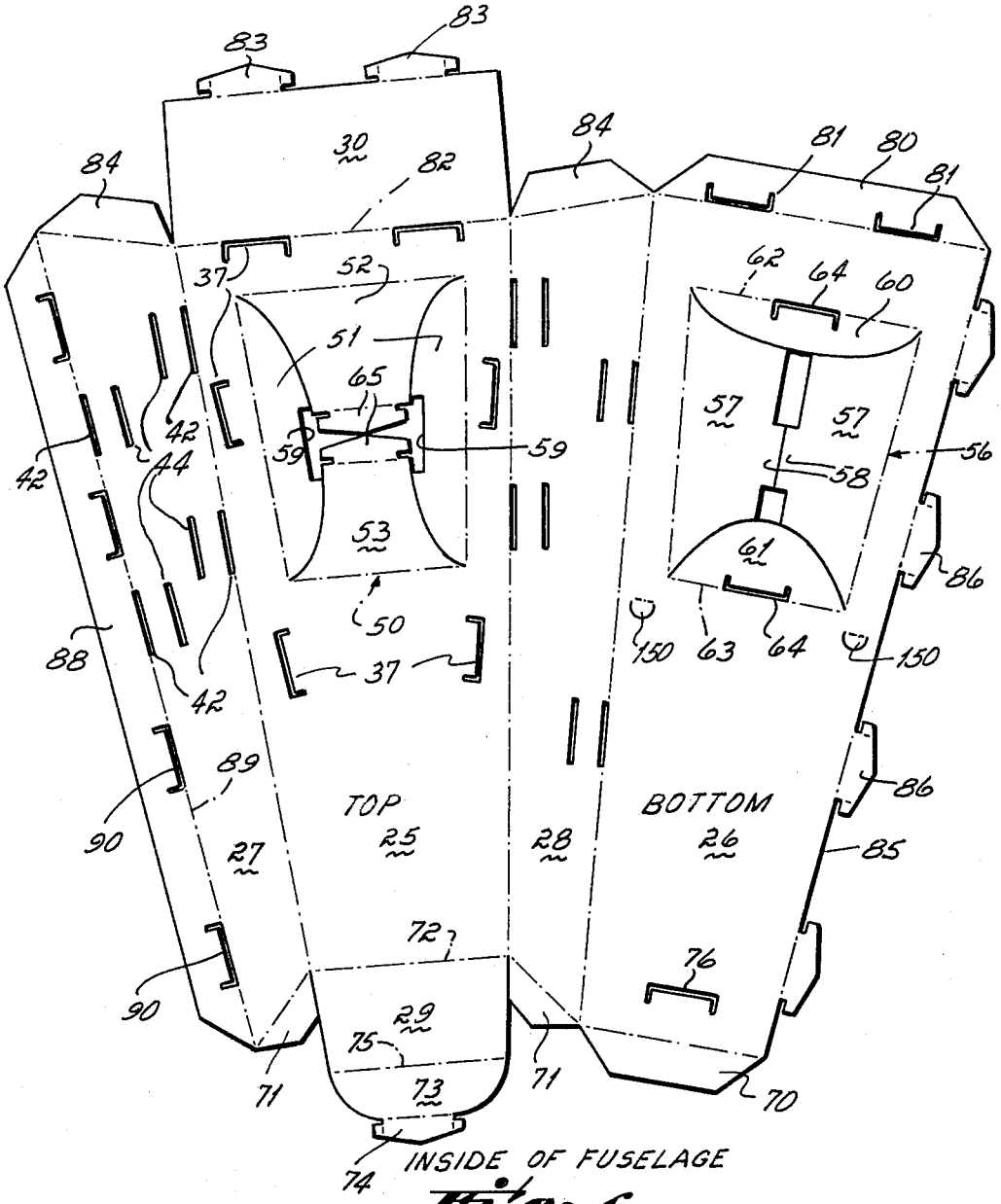
FIG. 6 is a plan view of a die-cut piece of corrugated board from which the fuselage is formed, the view being of the inside surface of the fuselage.
Figure 10:
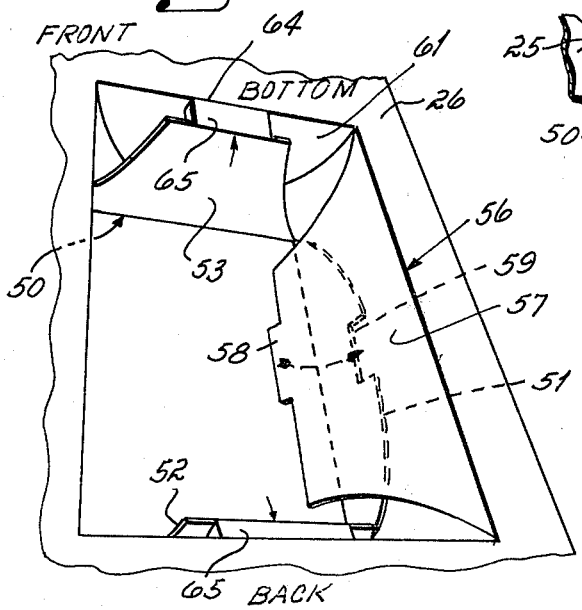

The remainder of the opening 56 is formed by die-cutting panels 60 and 61 at the rearward and forward ends of the opening 56. The panels 60 and 61 are folded upwardly along hinge lines 62 and 63. Each hinge line has a channel-shaped notch 64 (FIGS. 6 and 10). Each channel-shaped notch cooperates with a tab 65 on the respective ends of the downwardly-inclined panels 52 and 53 to lock the panels 52 and 53 over the panels 60 and 61 in the assembly of the cockpit portion of the fuselage. The space defined by the openings 50, 56 will be referred to as the cockpit area 54.

As best shown in FIG. 6, the bottom wall 26 has a forward end flap 70. The side walls 27 and 28 have forward side flaps 71. The top wall 25 has the end wall 29 hinged to it along a line 72 and a tuck flap 73 terminating in a lock tab 74 is hinged along a line 75 to the end wall. A channel-shaped slot 76 is provided in the forward end of the bottom wall to receive the lock tab 74. In closing the forward end of the fuselage after the fuselage is formed into a rectangular shape, the side flaps 71 are tucked inwardly. The end flap 70 is folded over the flaps 71 and finally the front end wall is folded around the end of the fuselage with the flap 73 overlying the bottom wall with the lock tab tucked into the channel-shaped slot 76.

At the rearward end of the fuselage, the bottom wall has an end flap 80, the end wall 80 having two channel-shaped slots 81.

The top wall has the rearward end wall 30 hinged along a line 82. The end wall terminates in locking tabs 83 which cooperate with the channel-shaped slots 81 in the flap 80. Side flaps 84 are connected to the perspective side walls 27 and 28. To close the rearward end of the fuselage after it has been folded to its rectangular shape, the side flaps are folded inwardly. The end flap 80 on the bottom wall is folded upwardly and the end wall 30 is folded over the side and end flaps 84 and 80, respectively, with the locking tabs 83 projecting into the slots 81.

The bottom panel 26 has along its side edge 85 a series of spaced lock tabs 86. Side wall 27 has a side flap 88 hinged to it along a line 89. The side flap 88 has a series of spaced channel-shaped notches 90 formed in it which are adapted to receive the lock tabs 86. When the fuselage is folded into a rectangular shape with the side flap 88 folded at right angles along the inside of the bottom wall, the locking tabs 86 are inserted into the channel-shaped slots 90 to secure the fuselage into a closed tubular configuration.

Figure 7:
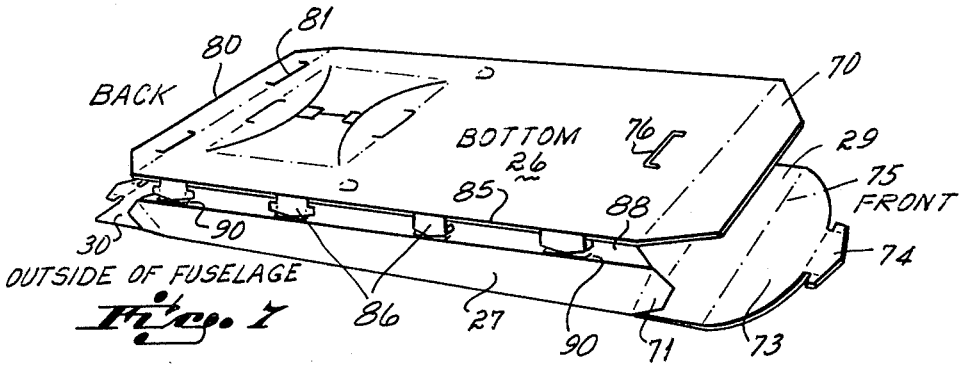
FIGS. 7 through 11 are perspective views of the steps in forming the fuselage from the blank of FIG. 6.
Figure 8:
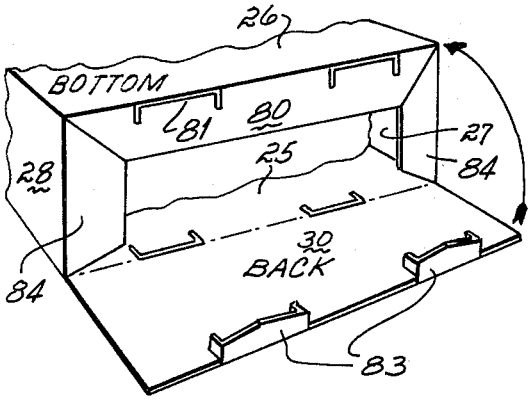
Figure 9:
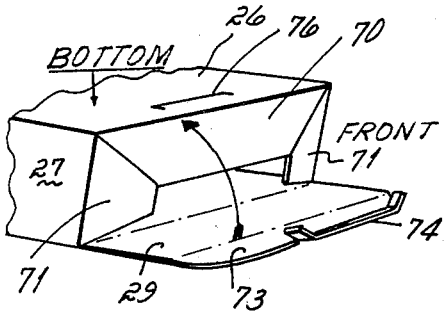

The sequence of steps for forming the fuselage is illustrated in FIGS. 7–11. As shown in FIG. 7, the walls 25 to 28 are first folded into the rectangular orientation shown. As shown in FIG. 8, at the rear of the fuselage the side flaps 84 are folded inwardly and the end flap 80 is folded alongside them with their edges in abutment. The back wall 30 is then folded over the flaps 80, 84 with the locking tabs 83 being inserted into the channel-shaped slots 81 to close the back of the fuselage.

At the forward end of the fuselage, the side flaps 71 are folded inwardly and the flap 70 is folded alongside them with their edges substantially in abutting relation. Then the front wall 29 is folded over the flaps 70 and 71. The flap 73 is folded to a position overlying the bottom wall and the locking tab 74 is inserted into the channel-shaped slot 76 to complete the enclosure of the front of the fuselage.

Figure 11:
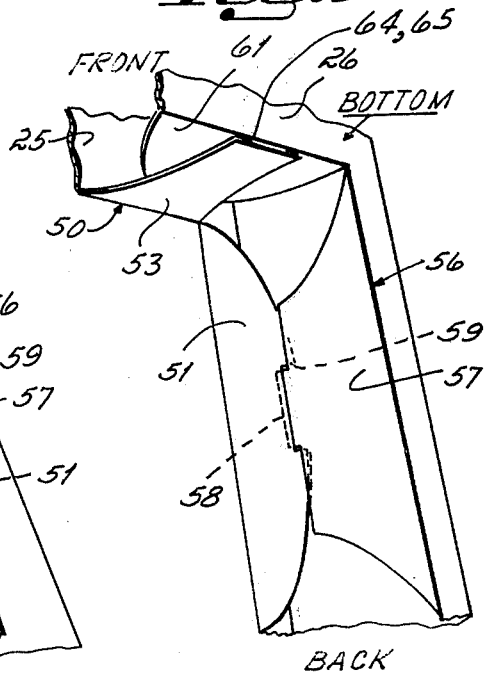

The folding of the panels forming the cockpit area 65 should be delayed until the canopy and wings are mounted on the fuselage so as to provide access to the interior of the fuselage, thereby facilitating the mounting of the canopy and wings to it. After the wings and canopy are mounted, the panels in the cockpit area are assembled as shown in FIGS. 10 and 11. First, the panels 60 and 61 are folded upwardly to expose the channel-shaped slots 64. Then the bracing panels 52 and 53 are folded downwardly and their locking tabs 65 are projected into the channel-shaped slots 64 to secure the panels 52 and 53 into position.

At each side of the cockpit, the panels 51 and 57 are folded inwardly with the tabs 58 sliding into the notches 59. These panels 51, 57 are forced or snapped through an over-center position until they spring against the inside of the fuselage, thereby locking those panels into position.

Figure 12:
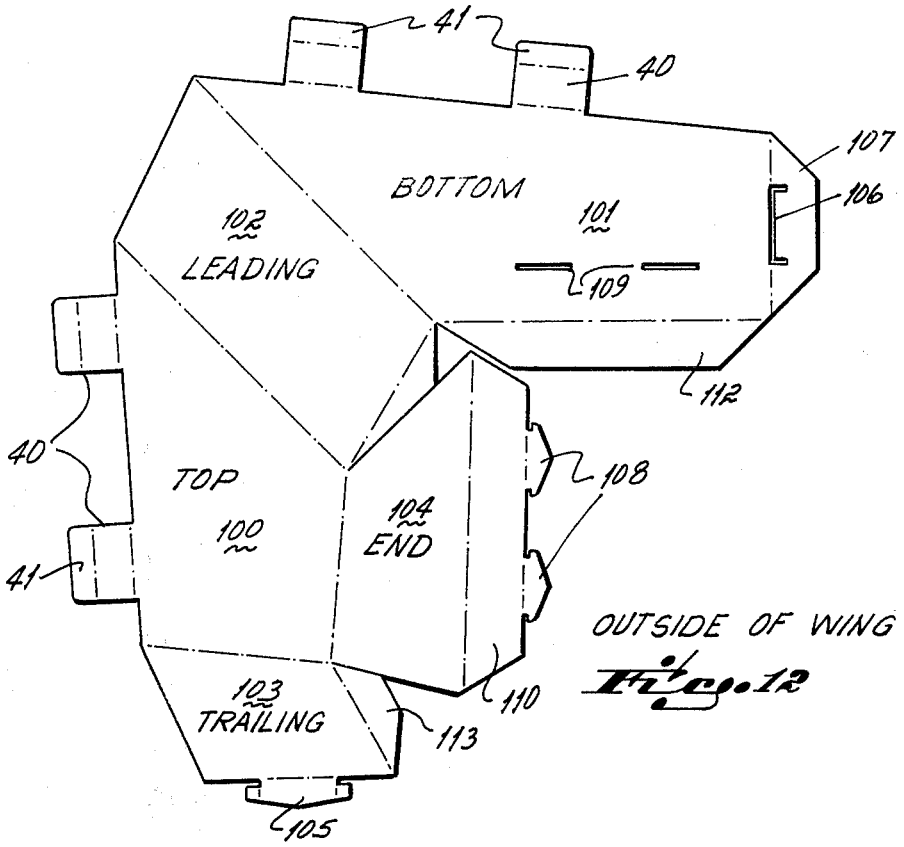
FIG. 12 is a perspective view of a piece of corrugated board from which the aircraft wings are formed.
Figure 13:
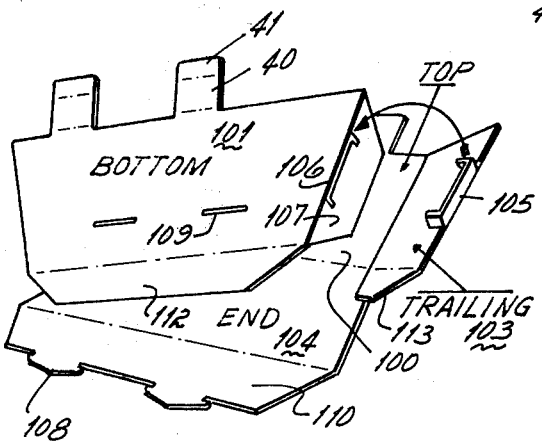
FIGS. 13 and 14 are perspective views of the steps of forming the wings.
Figure 14:
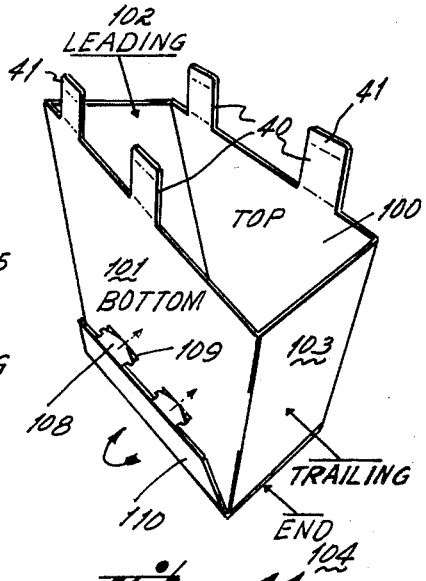

The assembly of the wing structure is illustrated in FIGS. 12–14. Each wing is of a generally box-like configuration having a top wall 100, a bottom wall 101, a leading wall 102, a trailing wall 103 and an end wall 104.

The top and bottom walls have projecting tabs 40, 41 as described above. The trailing wall 103 has a locking tab 105 which cooperates with a channel-shaped slot 106 formed in a flap 107 connected to the edge of the bottom wall 101.

The end wall 104 has a flap 110. The flap 110 has lock tabs 108 which cooperate with slots 109 on the bottom wall. The bottom wall has a flap 112 and the trailing wall 103 has a flap 113. To assemble the wing, the walls are folded together to form a box-like configuration (FIG. 13). The flap 107 is folded downwardly, and the trailing wall 103 is folded upwardly to overlie it. The lock tab 105 is inserted into the channel-shaped slot 106 to lock the trailing wall in position. The flap 112 is folded down and the end wall 104 folded upwardly. The end wall flap 110 is folded onto the bottom wall and the lock tabs 108 are inserted into the slots 109 to complete the assembly of the wing structure. Each wing is assembled to the fuselage simply by inserting the tabs 40, 41 into the slots 42 and then forcing the tabs 41 out of the slots 44.

Figure 15:
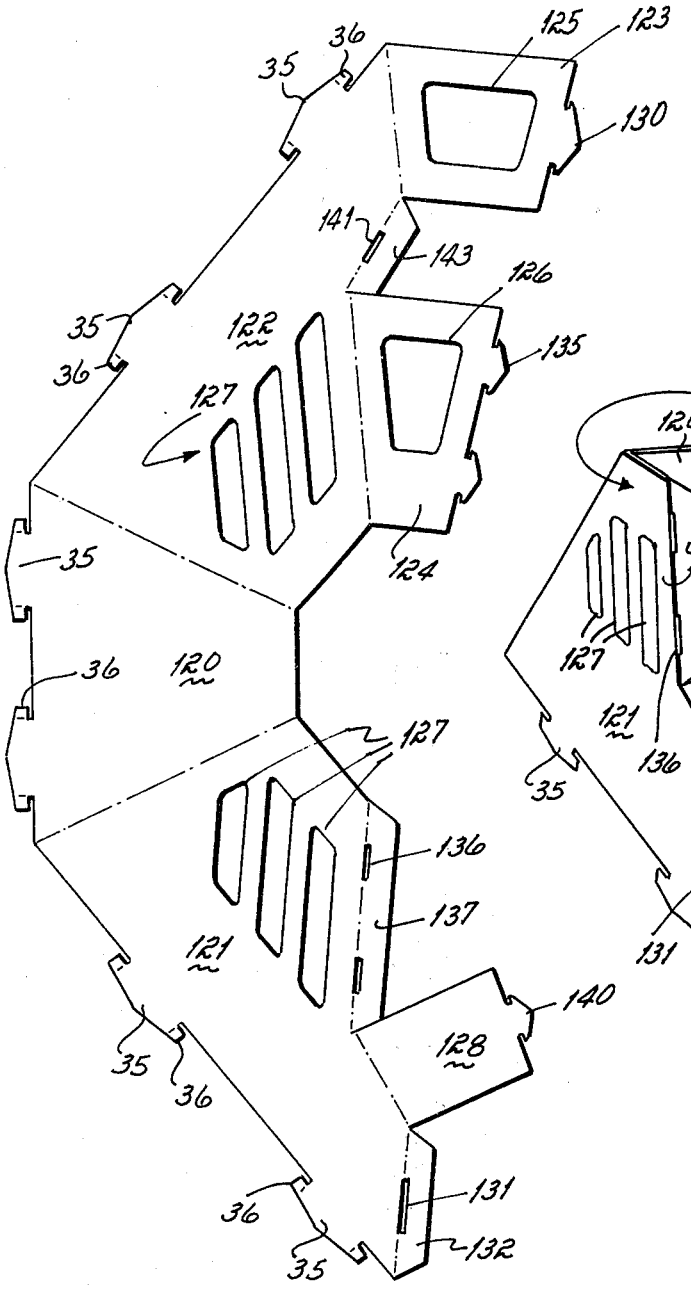
FIG. 15 is a plan view of a piece of corrugated board from which the canopy is formed.
Figure 16:
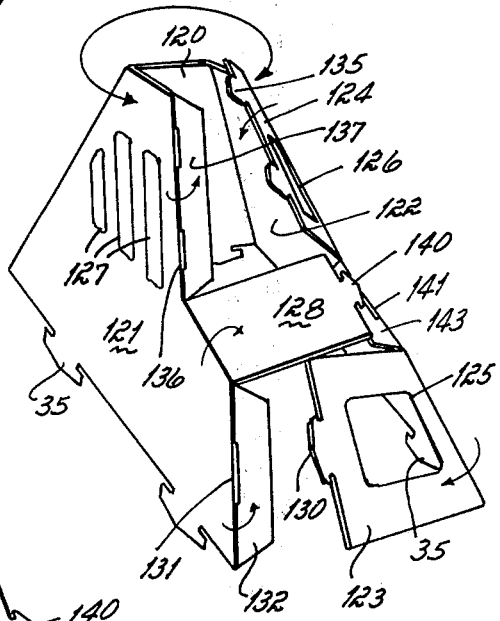
FIG. 16 is a perspective view illustrating the formation of the canopy from the blank of FIG. 15.

The canopy is another box-like structure whose formation and assembly is best shown in FIGS. 15 and 16.

The canopy 22 has a back wall 120 and two side walls 121, 122. The canopy has a stepped front wall including a lower panel 123 and an upper panel 124. Both panels have openings 125 and 126, respectively, through which the child pilot can see to maneuver his aircraft. The side panels 121 and 122 have a series of three openings 127 in order to provide visibility to the sides of the aircraft. A horizontal panel 128 extends across the front of the canopy between the upper and lower panels 124 and 123, respectively.

The lower panel has a lock tab 130 which cooperates with a slot 131 in the forward edge of side panel 121. The side panel 121 terminates in a flap 132 which carries the slot 131. The upper front panel 124 has two lock tabs 135 which cooperate with slots 136 in the forward edge of the side panel 121. The side panel 121 terminates in a flap 137 in which the slots 136 are formed.

The horizontal panel 128 has a lock tab 140 which cooperates with a slot 141 formed in side walls 122. The side wall 122 carries a flap 143 in which the slot 141 is formed.

Around the edges of the canopy, a series of spaced lock tabs 35, referred to above, are formed. These lock tabs cooperate with the channel-shaped slots 37 in the top wall of the fuselage.

The canopy is formed by folding the side walls around the rear wall 120 and swinging the front panels 123 and 124 toward the side wall 121 (FIG. 16). Similarly, the horizontal panel 128 is swung toward the side wall 122. The lock tabs 130, 135 and 140 are inserted into their respective slots 131, 136 and 141 to complete the assembly of the canopy. The canopy is mounted on the fuselage by inserting the lock tabs 35 into the corresponding channel-shaped slots 37 in the upper wall 25 of the fuselage.

As indicated above, after completing the assembly and mounting of the wings and canopy to the fuselage, the panels that form the cockpit are folded and locked into position in the manner described in connection with FIGS. 10 and 11.

The aircraft is then ready to fly. To fly it, the child first inserts his head and shoulders through the large openings 56 and 50 in the bottom and top walls of the fuselage, respectively, so that his head appears in the canopy. The complete assembly is very lightweight, being formed of corrugated paperboard, and can be supported substantially entirely on the forearms of the child by the engagement of the panels 51 in the cockpit with those forearms. The child may find it convenient to grasp the front bracing panel 53, upon which the instrumentation is printed. Alternatively, it may be advantageous to provide hand grips, as indicated in FIGS. 4 and 6, by striking out of the bottom wall semi-circular tabs 150 to form openings through which the fingers of the child can be passed to support the aircraft.

The aircraft can easily be disassembled and stored for future use. It has been found that with a little observation of the steps of assembling the aircraft, the child can do it by himself whenever he chooses to play with it.

Having described my invention, I claim:

1. A toy aircraft for a child comprising, a hollow fuselage, wings projecting laterally from each side of the fuselage, and a canopy mounted on top of the fuselage, said fuselage having a large opening in its lower surface to permit the head and shoulders of a child to be thrust into the fuselage, said fuselage having an opening in the upper surface thereof communicating with said canopy and through which the child may thrust its head into the space enclosed by the canopy, said fuselage having upper and lower walls connected by side walls, and a V-shaped internal wall disposed adjacent said side walls, the upper portion of said V-shaped internal wall providing a surface for engagement by the forearm of a child to support the aircraft.

2. A toy aircraft for a child comprising, a hollow fuselage, wings projecting laterally from each side of the fuselage, and a canopy mounted on top of the fuselage, said fuselage having a large opening in its lower surface to permit the head and shoulders of a child to be thrust into the fuselage, said fuselage having an opening in the upper surface thereof communicating with said canopy and through which the child may thrust its head into the space enclosed by the canopy, said fuselage having upper and lower walls connected by side walls, a V-shaped internal wall disposed adjacent said side walls, the upper portion of said V-shaped internal wall providing a surface for engagement by the forearm of a child to support the aircraft, said V-shaped wall being formed by a panel cut from the lower wall in forming said lower opening and a panel cut from said upper wall in forming said upper opening, and means snap-fitting the edges of said panel together to form said V-shaped wall.

3. A toy aircraft for a child comprising, a hollow fuselage, wings projecting laterally from each side of the fuselage, and a canopy mounted on top of the fuselage, said fuselage having a large opening in its lower surface to permit the head and shoulders of a child to be thrust into the fuselage, said fuselage having an opening in the upper surface thereof communicating with said canopy and through which the child may thrust its head into the space enclosed by the canopy, said fuselage having upper and lower walls connected by side walls, front and rear bracing panels and upper side panels cut from said upper wall to form the opening in said upper wall, front and rear flaps and lower side panels cut from said lower wall to form the opening in said lower wall, said bracing panels being connected to said lower wall, said upper and lower side panels having edges engaging each other to form a V-shaped internal side wall on each side of said fuselage.

4. A toy aircraft as in claim 3 in which the combined vertical dimension of said upper and lower side panels is greater than the height of said fuselage side wall, one panel edge having a notch and the other having a cooperating tab which is received in said notch, said panels being resiliently sprung over-center into their V-shaped configuration.

5. A toy aircraft for a child comprising, a hollow fuselage, wings projecting laterally from each side of the fuselage, and a canopy mounted on top of the fuselage, said fuselage having a large opening in its lower surface to permit the head and shoulders of a child to be thrust into the fuselage, said fuselage having an opening in the upper surface thereof communicating with said canopy and through which the child may thrust its head into the space enclosed by the canopy, said fuselage having upper and lower walls connected by side walls, said fuselage having internal side walls, said internal side walls providing surfaces for engagement by the forearms of the child to support the aircraft with the child's head and shoulders extending well into the fuselage and canopy.

* * * * *